US005433040A

United States Patent [19]

Morrison

[11] Patent Number: 5,433,040

[45] Date of Patent: Jul. 18, 1995

[54] WINDOW AND WINDOW HARDWARE STRUCTURE AND METHOD OF PRODUCING SAME

[76] Inventor: Patrick A. Morrison, 71 May Ave., Northfield, Ohio 44067

[21] Appl. No.: 106,549

[22] Filed: Aug. 16, 1993

[51] Int. Cl.[6] ..... E05C 21/02

[52] U.S. Cl. ..... 49/465; 49/246; 49/260

[58] Field of Search ..... 49/208, 246, 253, 463, 49/465, 260

[56] References Cited

U.S. PATENT DOCUMENTS

| | | | |
|---|---|---|---|
| Re. 32,846 | 1/1989 | Sandberg et al. . | |
| 2,661,508 | 12/1953 | Hubert | 49/463 |
| 2,926,399 | 3/1960 | Ramunas . | |
| 3,331,161 | 7/1967 | Ruff | 49/463 |
| 3,457,675 | 7/1969 | Armstrong . | |
| 3,797,169 | 3/1974 | Armstrong . | |
| 4,137,603 | 2/1979 | Kvasnes . | |
| 4,593,431 | 6/1986 | Sandberg et al. . | |
| 4,674,149 | 6/1987 | Vetter . | |
| 4,932,695 | 6/1990 | Pettit et al. . | |

FOREIGN PATENT DOCUMENTS

| | | | |
|---|---|---|---|
| 552685 | 12/1956 | Italy | 49/253 |

*Primary Examiner*—Michael J. Milano

[57] ABSTRACT

A hopper-type window sash movable from a closed position within an opening in a frame to an open position in which the sash extends at an angle from one edge located in the frame opening. Hardware includes a pivot slide supporting such one edge of the sash for pivotal and sliding movement along integral tracks provided in the frame. Opposed control assemblies each include a frame pivot member directly mounted in an associated track and a sash pivot member directly mounted on the sash. A thin control strap is pivoted at one end on the frame pivot member, and at its other end on the sash pivot member. One pivot is releasable to allow easy access for mounting all hardware while the sash and frame are separated. The control strap moves through a narrow opening between the sash and frame, permitting multiple seals to effectively seal the window.

15 Claims, 4 Drawing Sheets

Fig.1
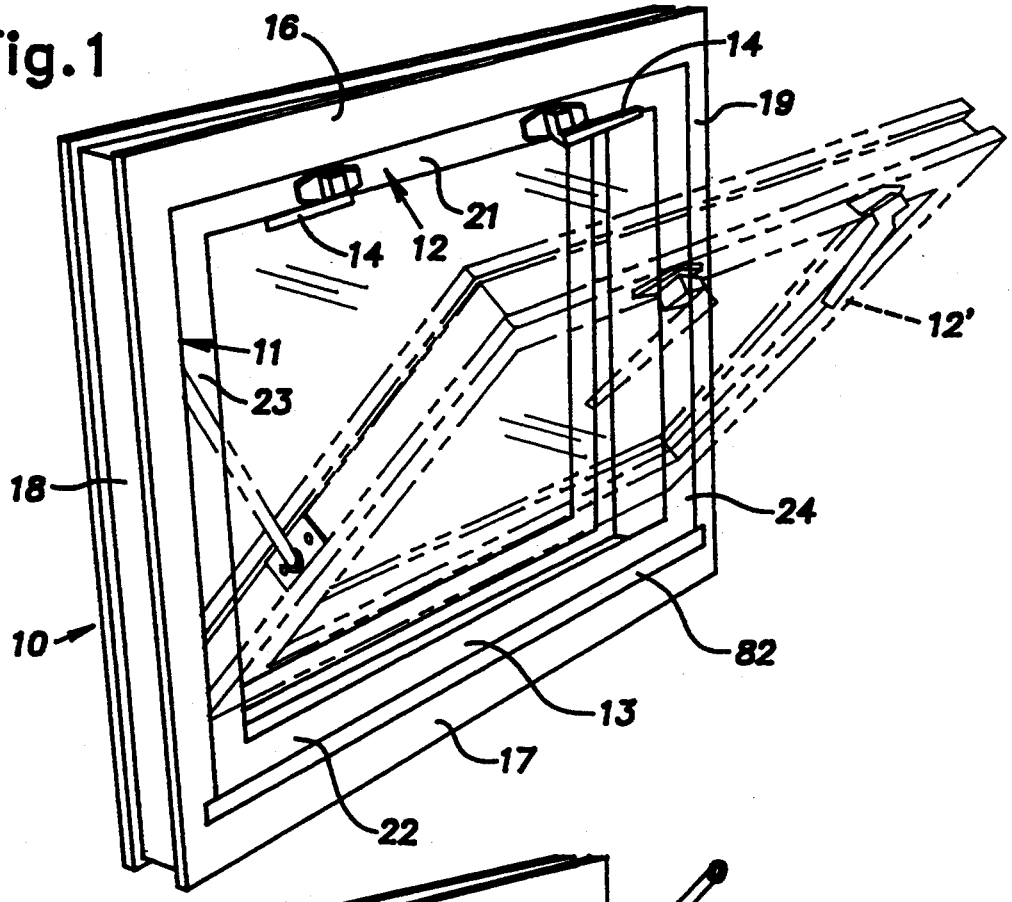
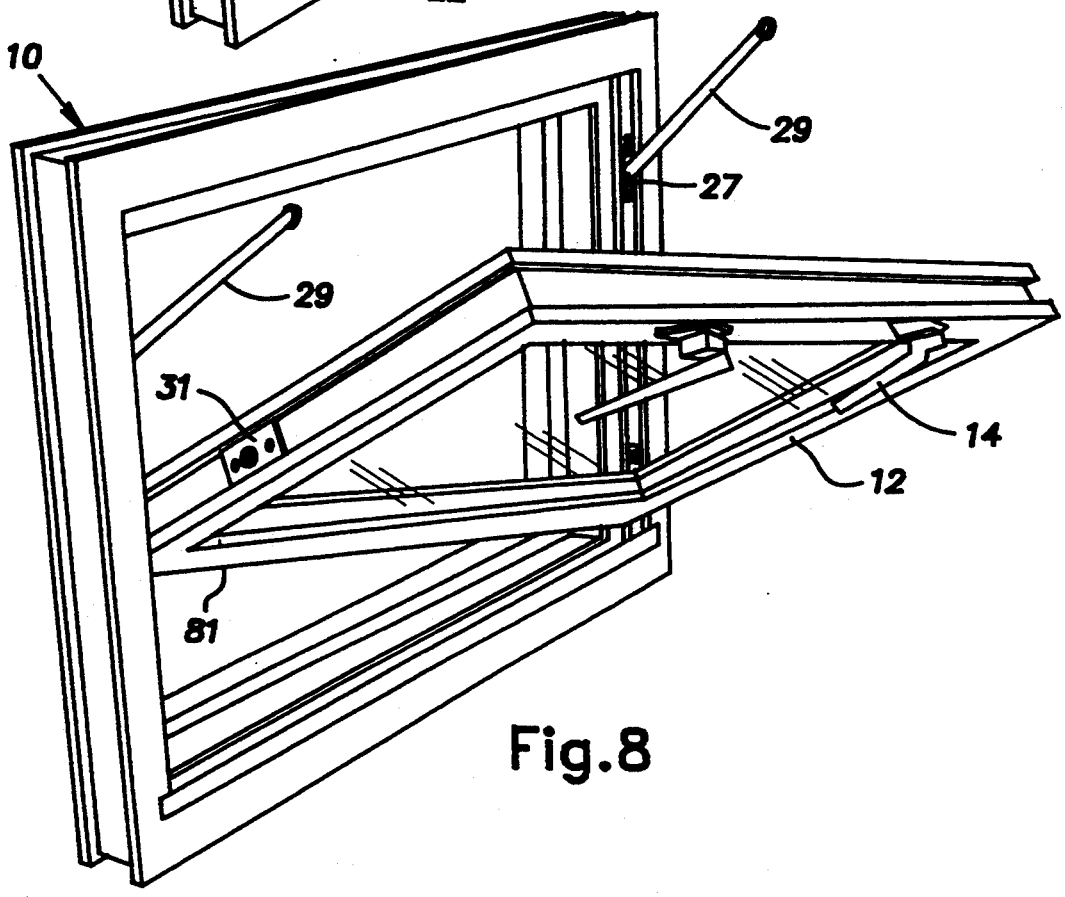
Fig.8

Fig.6A
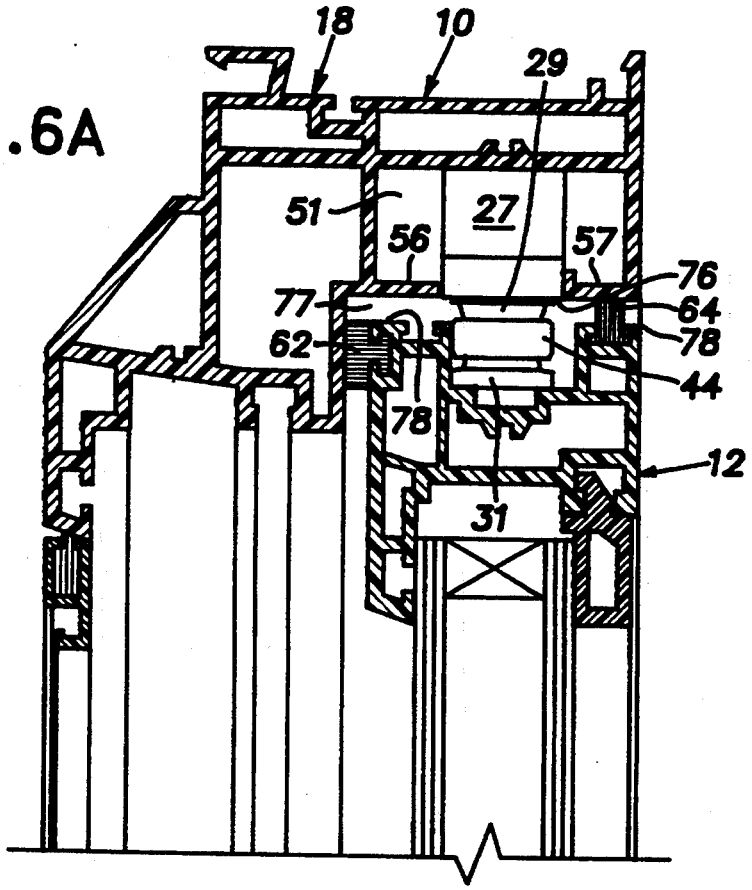
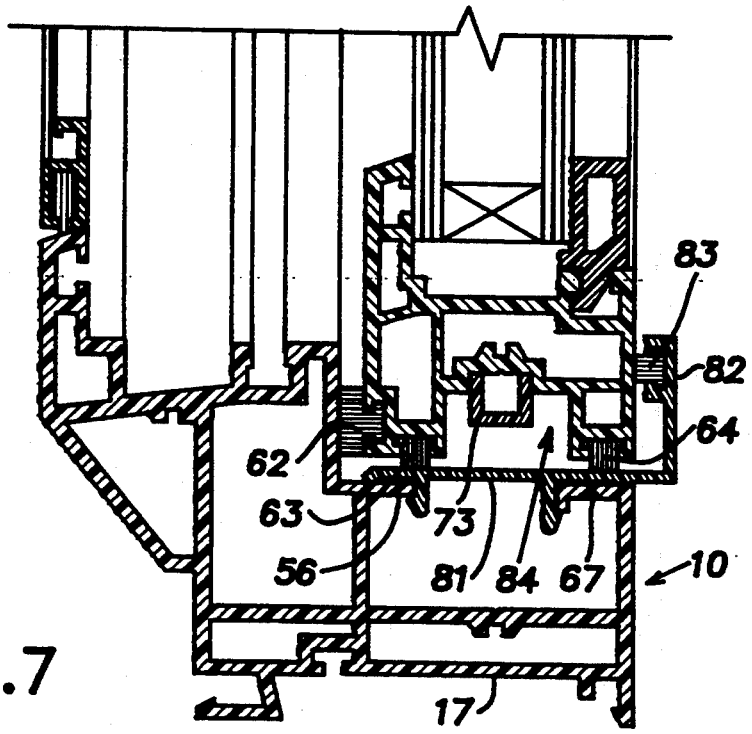
Fig.7

WINDOW AND WINDOW HARDWARE STRUCTURE AND METHOD OF PRODUCING SAME

BACKGROUND OF THE INVENTION

This invention relates generally to window structures and hardware, and more particularly, to a novel and improved swing or tilt-type window structure and hardware. The invention also relates to a novel and improved method of manufacturing same.

PRIOR ART

Tilt or swing windows and/or hardware therefore are illustrated in the U.S. Pat. Nos. 2,926,399; 3,457,675; 3,797,169; 4,137,603; 4,593,431 (its reissue No. Re. 32,846); U.S. Pat. Nos. 4,674,149; and 4,932,695, all of which are incorporated herein by reference to illustrate the general status of the prior art.

The aforementioned U.S. Pat. No. 3,457,675 illustrates a swing window having a sash pivoted along one edge on opposed slides which are slidable along a track provided by the window hardware. Opposed elongated straps have one end pivoted on the track member and an opposite end pivoted relative to the sash.

A related U.S. Pat. No. 4,593,431 and its reissue No. Re. 32,846 (both assigned to the same assignee as the '675 patent) is believed to illustrate the basic hardware system of the '675 patent and disclose that an elongated hardware member is pivotally connected to the slide and associated end of the strap. It is believed that this latter hardware member is connected to the sash by fasteners.

This latter '431 patent and its reissue, in addition, disclose a snap-type connection which releasably connects the pivot at one end of the strap. It is indicated that the releasable snap-type connection disclosed in the '431 patent facilitates the assembly of the window hardware with automated equipment.

The window system of these three patents is moveable from a closed position in alignment with the frame to an open position angulated with respect to the frame. As the sash moves to the open position, one edge thereof moves along the track mounted on the frame, while the sash tilts or swings out of the plane of the frame.

The structure of these three patents requires a relatively complicated and expensive hardware structure, including separate track hardware members and sash hardware members which must be respectively mounted on the frame and sash. This mounting system for the hardware requires installation of the hardware during the assembly of the sash and the frame.

SUMMARY OF THE INVENTION

The present invention has a number of important aspects. The present invention provides a novel and improved swing or tilt window structure and hardware structure which reduces the cost by minimizing the number of required components without losing any of the operating functions of the completed window.

Further, ease of manufacture is improved, and production costs are reduced. With the present invention, a track is incorporated into the frame itself, and therefore, it is not necessary to provide separate track elements. Opposed pivot slides are positioned in the associated tracks during frame assembly.

Opposed simple control strap assemblies include an elongated strap member, a pivot block pivotally connected at one end to the strap and structured for direct mounting on the frame. A releasable pivot structure is provided at the other end of the control strap. This connection releasably connects the strap and a pivot block directly mounted on the sash.

With this invention, all of the hardware is mounted on the sash and the frame before they are assembled together. Easy access is therefore provided for mounting the hardware.

After all of the hardware is mounted, the sash is installed in the frame by positioning one edge at an angle so that the slide pivots are connected to the sash. The sash is then squared with the frame, and the releasable pivots are connected to complete the assembly.

The present invention also provides a structure in which the user can remove the sash from the frame and, subsequently, reinstall the sash without the use of tools. In the case of emergency, egress can be achieved quicker and safer with a removal of the sash than would be possible by breaking the glass.

In accordance with another aspect of this invention, a structure is provided in which very low clearance is required between the sash and frame for the passage of the tilt control strap.

In accordance with another aspect of this invention, a swing or tilt window structure is provided having improved seals to minimize air or moisture leakage past the window.

The illustrated embodiment is a hoppertilt window in which the window swings about a horizontal pivot axis. However, the invention is also applicable to casement-type structures where the sash swings about a vertical pivot axis.

These and other aspects of this invention are illustrated in the accompanying drawings and are further described in the following specification.

BRIEF DESCRIPTION OF THE DRAWINGS

FIG. 1 is a perspective view illustrating one preferred embodiment of the window structure in full line in its closed position, and in phantom in its open or tilt position;

FIG. 6A is a fragmentary section similar to FIG. 6 but illustrating the structure at the location of the releasable pivot connection between the control strap and the sash pivot block;

FIG. 7 is a fragmentary cross-section through the base of the frame and sash again illustrating the seals which separately seal that portion of the window; and FIG. 8 is a perspective view illustrating the manner in which the window sash is installed within the frame (after all of the mounting hardware is installed) by angulating the sash with respect to the frame to connect the window sash and the slide pivots.

DETAILED DESCRIPTION OF THE DRAWINGS

Figure 2:
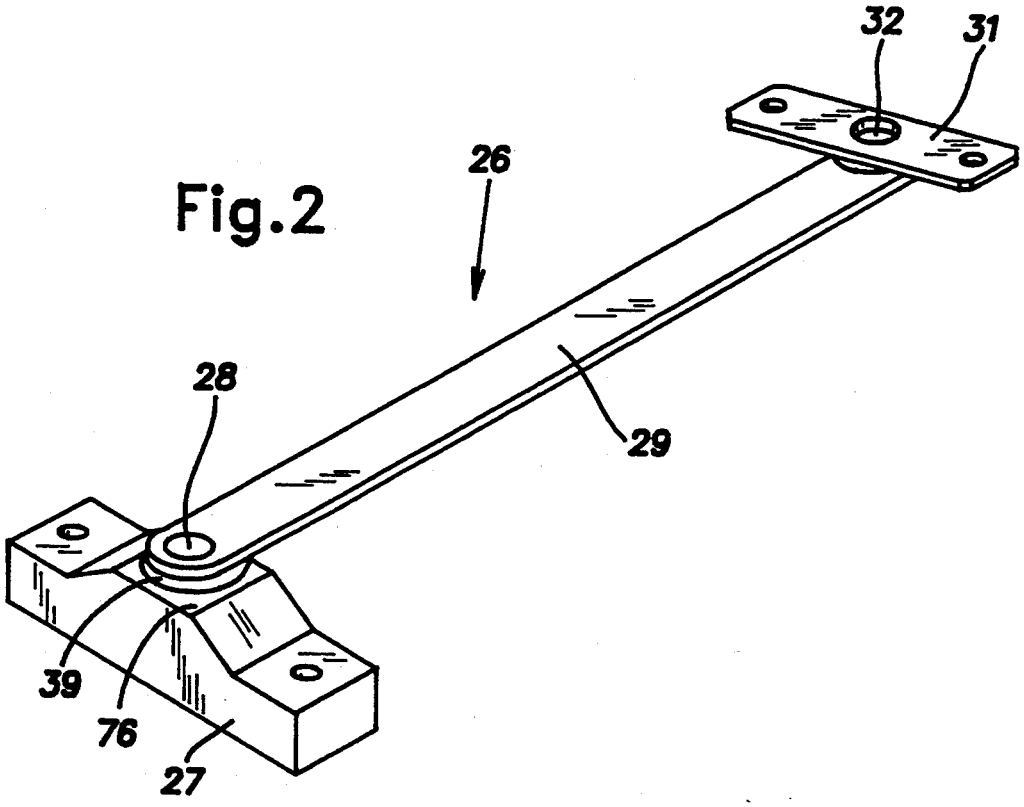
FIG. 2 is a perspective view of a control strap assembly which includes the control strap pivotally connected at one end to a frame pivot block and pivotally connected at its opposite end to a sash pivot block.

The illustrated embodiment provides a frame 10, preferably formed of extruded plastic material, which is immune to corrosion or rotting. The frame provides a sash-receiving opening 11 in which a sash 12 is mounted. Here again, the sash is, preferably, formed of extruded plastic material of the same type as the frame. As illustrated in FIG. 1, the sash 12 is moveable between a closed position, illustrated in full line, in which it is located within the substantially planar opening 11 and an open position, illustrated in phantom at 12'. As discussed in detail below, the lower sash member 13 extends to the lower end of the opening 11 when the sash is in the closed position, but raises up away from the lower edge of the opening 11 as the sash is moved to its open position, illustrated in phantom.

The illustrated sash is also provided with locking levers pivoted on the sash 12 and having an extension which fits up into openings (not illustrated) in a frame header 16. These locking levers operate to releasably lock the sash in the closed position, illustrated in full line.

The frame 10 includes an upper header 16, a base member lower header 17, and two opposed side members 18 and 19. For purposes of ease of understanding of the structure being described, reference to some of the components include upper and lower designations which correspond to the illustrated preferred embodiment. However, it should be understood that these terms are not to be construed as limiting the invention to a window structure which is oriented in the position illustrated in the drawings. As pointed out previously, this invention can also be applied to structure's positioned so that the window swings about a vertically-extending edge, or for that matter, in which the orientation of the window is reversed by 180°. The sash is also formed as a rectangle having an upper sash header 21, a lower sash header 22, and opposed sash side members 23 and 24.

The lower sash header 13 provides a lower sash edge positioned adjacent to the lower extremity of the opening 11 in the closed position, and the remaining sash components are sized to closely fit the adjacent frame components in the closed position so as to completely close the opening 11 in the frame.

Figure 3:
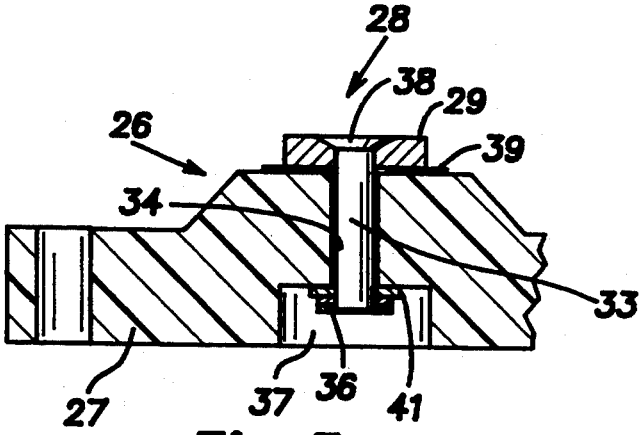
FIG. 3 is a fragmentary cross-section through the pivot connection between the frame pivot block and the control strap.
Figure 4:
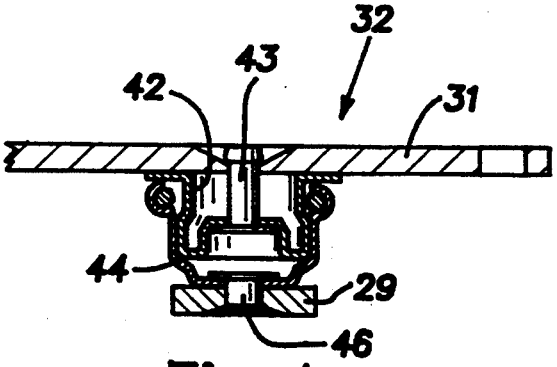
FIG. 4 is a fragmentary cross-section illustrating the structure of the releasable pivot connection between the control strap and the sash pivot block.

Mounted on each side of the frame is hardware constituting a control assembly 26, best illustrated in FIGS. 2–4. Each of the assemblies includes a frame pivot block 27 connected by a pivot 28 to one end of a control strap 29. The assembly also includes a sash pivot block 31 connected by a pivot 32 to the opposite end of the control strap 29. The detailed structure of the pivot 28 is best illustrated in FIG. 3. The pivot 28 includes a rivet 33 which extends along a cylindrical passage 34 formed in the pivot block 27. The rivet 33 has a head 36 located in a recess 37 in the frame pivot block 27 and is flared at its end 38 in a matching opening in the control strap 29. Preferably, wear washer-like bearings 39 and 41 are provided to insure that the pivot 28 will allow easy and smooth pivotal movement.

The pivot 32, which connects the opposite end of the control strap 29 to the sash pivot block 31, is provided with a snap-type connection, allowing easy connection and disconnection of the pivot 32. In the illustrated embodiment, a snap-type releasable connection normally referred to as a "DOT" connector (manufactured by Scovill Fasteners, Inc. of Watertown, Mass.) is provided at the pivot 32. The male element 42 of the DOT connector is mounted on the sash pivot block 31 by a rivet 43. The female element 44 is mounted on the end of the control strap 29 by a rivet 46. The pivotal connection is connected without any tools by merely pressing the female element 41 toward the male element 42 until it snaps into the assembled position illustrated in FIG. 4. Release of the pivotal connection is accomplished by merely applying a lateral separating force to the adjacent end of the control strap 29, causing the female element to snap back off of the male element. Such DOT type connectors are well-known and are commercially available. For example, connectors of such type are often used in the mounting of canvas on boats or other structures.

It should be noted that the pivot 28 does not provide any structure extending beyond the side of the control strap 29 remote from the pivot block 27. Similarly, the pivot 32 does not provide any structure extending beyond the side of the control strap 29 remote from the pivot block 31. By providing such a structure, it is possible to construct the sash and the frame so that a minimum clearance opening is provided between the two elements through which the control strap 29 extends as the window sash is moved to an open position. This narrow clearance also permits the provision of a superior sealing structure between the sash and the frame to insure a minimum of leakage of air or moisture past such seals.

Figure 5:
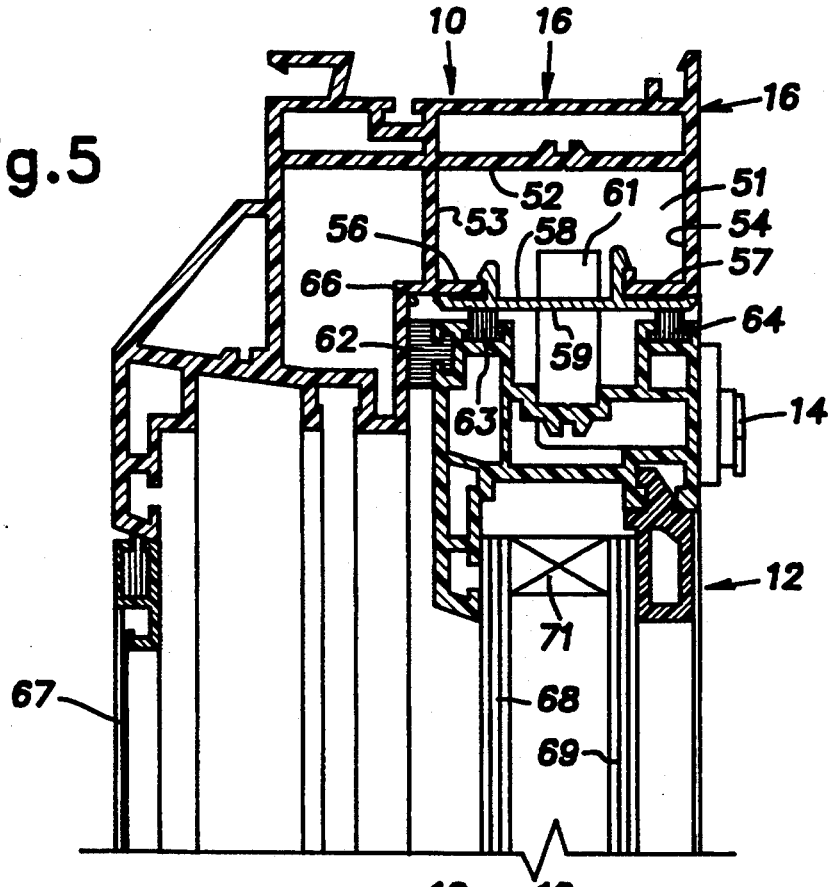
FIG. 5 is a fragmentary cross-section through the upper or header portion of the window illustrating the three resilient seals which extend along the header and sash interface.
Figure 6:
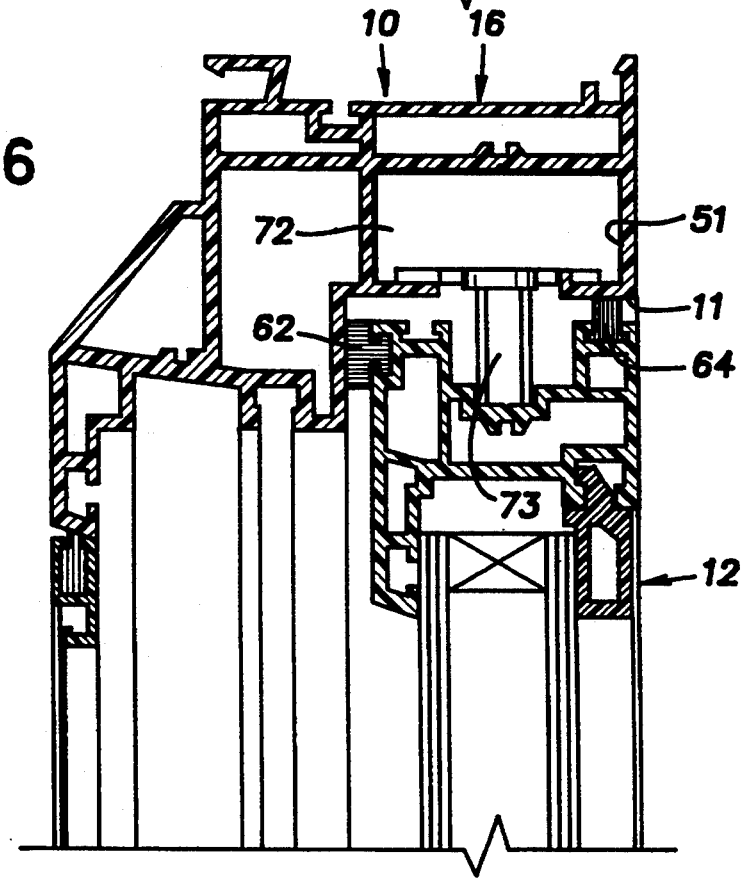
FIG. 6 is a fragmentary cross-section through one of the side frame members and sash member at the lower end thereof illustrating a slide pivot and its connection between the frame and the sash.

Reference should now be made to FIGS. 5–7 which illustrate the structural detail of the various components and sub-assemblies of the preferred illustrated embodiment of this invention. FIG. 5 is a fragmentary cross-section taken through the upper header of the window. A frame header 16 is formed as an extrusion of plastic material. One suitable plastic for forming such element is PVC. The headers and side frame members include a track portion 51 which extends lengthwise of the header 16 and is defined by a first wall 52, two opposed side walls 53 and 54, and inturned stub walls 56 and 57. The inner edges of the stub walls 56 and 57 are spaced apart and provide a longitudinally-extending opening.

Since the track of the upper header does not provide a functioning portion of the window structure, a cover plate 58 is snapped into the opening and forms a closure having a sealing surface 59, constituting a portion of the boundary of the sash-receiving opening 11.

The locking levers 14 are pivotally mounted in the sash 12 and provide an arm 61 which is rotated up through an opening in the cover plate 58 (not illustrated) to secure the window in the closed position.

Three sealing strips of conventional structure 62, 63, and 64 extend lengthwise along the upper portion of the sash. The sealing strips 63 and 64 engage the sealing surface 59 at spaced locations. The third sealing strip 62 engages and seals with a sealing surface 66 in the frame 10.

In the illustrated embodiment, a screen 67 is mounted in the frame along the side thereof opposite the sash 12.

Insulated glass, consisting of two spaced panes of glass 68 and 69 are mounted in the sash 12 and are connected by a seal 71.

FIG. 6 is a fragmentary section of the side of the window structure adjacent to the lower edge of the sash 12. Mounted in the track 51 at such location is a pivot slide block 72 which is vertically slidable within the track, allowing the lower edge of the sash to move vertically along the plane of the opening 11. The sash 12 is connected to the pivot slide block 72 by a U-shaped pivot shaft 73 mounted on the lower edge of the sash 12. The pivot shaft fits into a mating opening in the pivot slide block, providing a pivot-type connection which allows rotation of the lower edge of the sash as such edge raises up along the frame to the open position.

Preferably, the slide blocks are provided with a camming system which increases the friction-resisting movement of the slide block along the track 51 as the window pivots out during the opening operation. This increased friction stabilizes the window as it moves to greater angles of open.

Along the sides of the window, there are only two seals 62 and 64. The third seal 63 does not extend along the sides of the sash.

FIG. 6A is a fragmentary section illustrating the placement of the control assembly 26, illustrated in FIG. 2. The pivot block 27 is mounted in the track 51 by fasteners (not illustrated). As best illustrated in FIG. 6A, the pivot block 27 has a width equal to the width of the opening between the stub walls 56 and 57 and provides a face 76 aligned with the innerface of such stub walls. The control strap 29 extends along a space 77 bounded on its outer side by the adjacent surface of the two stub walls 56 and 57 and on its inner side by surfaces 78 of the sash 12. Such opening is slightly wider than the thickness of the control strap to provide clearances.

The sash pivot block 31 is mounted in a longitudinally-extending recess within the sash 12 and is pivotally connected to the control strap 29 by the DOT snap releasable connection. The female element of the DOT snap connector is positioned so that its outer surface is substantially flush with the side surfaces 78.

When the window is tipped to the open position, the control strap of each control assembly 26 extends out of the sash along the opening 77, as best illustrated in phantom in FIG. 1. The control assembly does not interfere in any way with the seal strips 62 and 64. However, when the window is in the closed position, these two spaced seal strips provide a very effective seal along the sides of the window.

FIG. 7 is a fragmentary section through the lower header 17 illustrating the structure at the bottom of the window. Here again, the header 17 is formed from the same extrusion as the side frame members 18 and 19 and the frame header 16. The longitudinal opening between the stub walls 56 and 57 is closed by a snap-in cover plate 81 which is similar in many respects to the cover plate 59. It differs therefrom, however, by providing an upstanding wall 82 which supports a fourth seal strip 83. In the illustrated embodiment, there are four seal strips 62, 63, 64, and 83 along the lower header providing a very effective seal along the lower portion of the sash and the lower header of the frame 10. The seal strips 62, 63, and 64 are all mounted on the sash while the strip 83 is mounted on the upstanding wall 82 of the frame 10. The two seal strips 62 and 64 extend completely around the sash. The seal strips 63 are mounted only along the upper and lower edges of the sash. The seal strip 83 extends only along the upstanding wall or sill at the lower side of the frame.

When the window is in the closed position, the control strap 29 extends parallel to the plane of the opening 11 and the sash 12. As the top of the window is pivoted or tilted inwardly, the control strap moves to an angled position and causes the lower edge 84 of the sash to raise up clear of the seal 83 without actually engaging the upstanding wall or sill 82. Because the pivot shaft 73 is mounted on the sash at the lower edge, the lower edge 84 of the sash is constrained by the movement of the pivot slide block along the track 72 to movement along the opening 11. The lower portion of the sash raises as the window opens. This permits the provision of a full sill 82 on the frame.

The control hardware for the control of the movement of the sash 12 relative to the frame as it moves between the open and closed position consists of the control assembly 26 and the pivot assembly, including the pivot slide block 72 and the pivot shaft 73. It should be understood that similar but opposite mounting hardware is provided along each side of the window. Structure, however, of the hardware is identical along each side and is merely mounted in an opposite orientation. Further, if desired, both ends of each control strap can be provided with a releasable pivot connection with the associated pivot block.

With the present structure, a minimum amount of mounting hardware is required, and all of the hardware can be mounted on the sash or frame, as the case may be, before the sash is assembled in the frame. The preferred method of manufacture is as follows. The two pivot slide blocks 72 are positioned within the tracks 51 of the two side frame members 18 and 19 before they are connected to the headers to complete the assembly of the frame. The pivot shafts 73 are separately mounted on the lower edge 84 of the sash 12. The pivot blocks, with the assembled control straps 29, are mounted within the tracks 51. During such mounting, the sash pivot blocks 31 are separated from the assembly by releasing the DOT-type releasable pivot connectors between the other end of the straps 29 and the sash-mounting blocks 31.

The sash-mounting blocks are mounted in the two side frame members in the appropriate location to complete the mounting of all of the hardware for supporting and controlling the movement of the sash.

All of this mounting is performed before the sash and the frame are assembled together and while complete access is provided for ease of the mounting of the hardware.

The final assembly of the window is accomplished, as best illustrated in FIG. 8. The slide pivots are connected by tipping the sash so that the lower edge 81 is angled with respect to the opening. At the same time, the slide pivot blocks are positioned within the tracks, with one at a higher location than the other. This increases the spacing between the opposed pivot slide blocks and allows the pivot shaft associated with each of the pivot slide blocks to be inserted into the mating opening within the pivot slide blocks. The lower edge 81 of the sash 12 is then squared within the opening. Assembly is then completed by merely connecting the associated male and female elements 42 and 44 of the releasable DOT connector to connect the sash pivot block to the ends of the associated control straps 29.

This hardware also allows the user of the window to completely remove the sash by reversing the assembly method just described and to reassemble the sash within the window frame by the method described above.

Close clearance assembly is provided since the opening 77 need only be slightly wider than the thickness of the control strap 29. Further, the control strap, because it is not subjected to any substantial bending loads, is relatively thin. In the illustrated embodiment, the control strap has a thickness in the order of one-sixteenth of an inch, and the opening 77 is only slightly wider. Because the pivot 28 does not extend beyond the side of the control strap remote from the pivot block 27, a clearance problem is not presented with respect to the window. Similarly, the pivot 32, because it is structured to be flush with the side of the control strap remote from the sash pivot block, does not provide any interference with respect to the frame, even though the opening 77 between the sides of the frame and the sash is narrow. Further, because such opening is narrow, it is possible to provide superior sealing between the sash and the frame by providing multiple sealing strips.

Although the preferred embodiment of this invention has been shown and described, it should be understood that various modifications and rearrangements of the parts may be resorted to without departing from the scope of the invention as disclosed and claimed herein.

What is claimed is:

1. A window comprising a generally planar frame having a sash-receiving opening and providing opposed recessed tracks, a sash mounted in said frame for movement between a closed position within said opening and an open position in which said sash extends from one edge within said opening at a substantial angle relative to said opening, mounting hardware including a slide member slidable along each of said tracks and pivotally connected to said sash along said one edge, movement of said sash between said open position and closed position causing said slide members and said one edge of said sash to move along said sash-receiving opening, said mounting hardware also providing a pair of hinge assemblies with each hinge assembly including:

(a) first pivot members directly mounted on said frame, second pivot members directly mounted on said sash, and an elongated strap having one end pivotally connected to said first pivot member and its other end pivotally connected to said second pivot member; and (b) at least one of the connections between said strap and said pivot members being releasable to permit installation of said sash within said frame and removal of said sash therefrom after said mounting hardware is installed without removing any of said pivot members from the associated one of said frame and said sash.

2. A window as set forth in claim 1, wherein each of said straps has a thickness substantially less than its width, and said sash and frame provide a clearance space associated with each strap having a width exceeding said thickness of the associated strap a sufficient amount to provide a small clearance in which said straps are positioned and move with clearance.

3. A window as set forth in claim 2, wherein said pivots connecting said straps to associated pivot members do not extend beyond the sides of said straps remote from the associated pivot member.

4. A window as set forth in claim 1, wherein said pivots connecting said strap to associated pivot members do not extend beyond the sides of said strap remote from the associated pivot member.

5. A window as set forth in claim 1, wherein two spaced strip seals seal between said frame and said sash on both sides of said mounting hardware when said sash is in said closed position.

6. A window as set forth in claim 5, wherein said hinge assemblies are free of contact with said strip seals during movement of said sash between said open and closed positions.

7. A window as set forth in claim 6, wherein a third strip seal seals between said sash and said frame along said one edge of said sash and along an edge of said sash opposite said one edge.

8. A window as set forth in claim 7, wherein said two strip seals and said third strip seal are all mounted on said sash.

9. A window as set forth in claim 7, wherein a fourth strip seal seals between said sash and frame along said one edge of said sash.

10. A window comprising a generally planar frame having a sash-receiving opening providing opposed recessed tracks, a sash mounted on said frame for movement between a closed position within said opening and an open position in which one edge of said sash is positioned within said opening and said sash extends from said opening at a substantial angle relative thereto, said sash being mounted in said frame by similar opposed mounting assemblies associated with each track, each mounting assembly including:

(a) a pivot slide releasably connected to said sash adjacent to said one edge thereof and slidable along the associated track;

(b) an elongated strap having ends;

(c) a first pivot member directly mounted on said frame and pivotally connected to one end of said strap;

(d) a second pivot member directly mounted on said sash and pivotally connected to the other end of said strap;

(e) at least one of said pivotal connections between said strap and said pivot members being releasable without tools; and release of said at least one of said pivotal connections allowing movement of said sash to a position in which said one edge is inclined relative to said frame causing release of the pivot slides and permitting removal of said sash from said frame.

11. A hinge assembly for tilting windows having a frame defining a sash-receiving opening and a sash moveable relative to said frame from a closed position within said opening to an open position in which said sash extends at an angle relative to said opening from one edge located within said opening, said hinge assembly comprising a frame pivot block adapted to be recess-mounted directly on said frame, a sash pivot block adapted to be recess-mounted directly on said sash, an elongated control strap having ends, a first pivot pivotally connecting one end of said control strap to said frame pivot block, a second pivot connecting the other end of said strap to said sash pivot block, at least one of said pivots being connectable and releasable, and where said first pivot and said second pivot do not extend beyond the surface of said strap remote from the associated pivot block.

12. A hinge assembly for tilting windows having a frame defining a sash-receiving opening and a sash movable relative to said frame from a closed position within said opening to an open position in which said sash extends at an angle relative to said opening from one edge located within said opening, said hinge assembly comprising a frame pivot element adapted to be recessed mounted directly on said frame, a sash pivot element adapted to be mounted directly on said sash, an elongated control strap having ends, a first pivot pivotly connecting one end of said control strap to said frame pivot element, a second pivot connecting the other end of said strap to said sash pivot element, at least one of said pivots being connectable and releasable, said one pivot including male and female elements which snap together during assembly and are snapped apart for release.

13. A method of manufacturing tiltable windows, comprising assembling a frame defining a sash-receiving opening, assembling a sash, mounting all of the frame hardware on said frame while said frame and sash are separated, mounting all of said sash hardware on said sash while said frame and sash are separated, and thereafter assembling said sash in said sash-receiving opening.

14. A method as set forth in claim 13, including providing a control strap with ends pivoted to pivot blocks mountable on said frame and said sash, and providing a releasable pivot connecting one end of said control strap with an associated pivot block.

15. A method as set forth in claim 13 including providing a control strap with ends pivoted to pivot elements mountable on said frame and said sash, and providing a releasable pivot connecting one end of the control strap with an associated pivot element.

* * * * *